US009948007B2

(12) United States Patent
Wright et al.

(10) Patent No.: US 9,948,007 B2
(45) Date of Patent: Apr. 17, 2018

(54) SUBTERRANEAN ANTENNA INCLUDING ANTENNA ELEMENT AND COAXIAL LINE THEREIN AND RELATED METHODS

(75) Inventors: Brian Wright, Indialantic, FL (US); Daniel L. Dickey, Rowlett, TX (US); Raymond Hewit, Palm Bay, FL (US)

(73) Assignees: HARRIS CORPORATION, Melbourne, FL (US); CONTINENTAL ELECTRONICS CORPORATION, Dallas, TX (US)

( * ) Notice: Subject to any disclaimer, the term of this patent is extended or adjusted under 35 U.S.C. 154(b) by 1580 days.

(21) Appl. No.: 13/525,877

(22) Filed: Jun. 18, 2012

(65) Prior Publication Data

US 2013/0334205 A1 Dec. 19, 2013

(51) Int. Cl.

| | |
|---|---|
| ***H05B 3/08*** | (2006.01) |
| ***H01Q 9/16*** | (2006.01) |
| ***H01Q 1/04*** | (2006.01) |
| ***E21B 43/24*** | (2006.01) |

(52) U.S. Cl.

CPC ..... *H01Q 9/16* (2013.01); *E21B 43/2401* (2013.01); *E21B 43/2406* (2013.01); *H01Q 1/04* (2013.01); *Y10T 29/49016* (2015.01)

(58) Field of Classification Search

CPC ... E21B 43/2406; E21B 43/2401; H01Q 1/04; H01Q 9/16

USPC ..... 219/541, 679; 439/578, 271, 429, 581, 439/583; 403/286, 292, 293, 294, 296, 403/298

See application file for complete search history.

(56) References Cited

U.S. PATENT DOCUMENTS

| | | | | |
|---|---|---|---|---|
| 4,583,589 | A | 4/1986 | Kasevich | |
| 7,121,881 | B2 | 10/2006 | Jones | |
| 7,441,597 | B2 | 10/2008 | Kasevich | |
| 7,891,421 | B2 | 2/2011 | Kasevich | |
| 2004/0114995 | A1* | 6/2004 | Jones | 403/294 |
| 2010/0065265 | A1* | 3/2010 | Kasevich | 166/248 |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |

* cited by examiner

*Primary Examiner* — Phuong Nguyen

(74) *Attorney, Agent, or Firm* — Allen, Dyer, Doppelt + Gilchrist, P.A. Attorneys at Law

(57) ABSTRACT

An antenna assembly may be positioned within a wellbore in a subterranean formation. The antenna assembly includes a tubular antenna element to be positioned within the wellbore, and an RF coaxial transmission line to be positioned within the tubular antenna element. The RF coaxial transmission line includes a series of coaxial sections coupled together in end-to-end relation, each coaxial section including an inner conductor, an outer conductor surrounding the inner conductor, and a dielectric therebetween. Each of the outer conductors has opposing threaded ends defining overlapping mechanical threaded joints with adjacent outer conductors.

18 Claims, 7 Drawing Sheets

SUBTERRANEAN ANTENNA INCLUDING ANTENNA ELEMENT AND COAXIAL LINE THEREIN AND RELATED METHODS

FIELD OF THE INVENTION

The present invention relates to the field of hydrocarbon resource processing equipment, and, more particularly, to an antenna assembly and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale.

In RF heating applications, a rigid coaxial feed arrangement or transmission line may be desired to couple to a transducer in the subterranean formation. Typical commercial designs of a rigid coaxial feed arrangement are not generally designed for structural loading or subterranean use, as installation generally requires long runs of the transmission line along the lines of 500-1500 meters, for example.

One approach to the transmission line comprises a plurality of rigid coaxial sections coupled together with bolted flanges at the ends. A potential drawback to this approach is that when taking into consideration the necessary dielectric standoff between the antenna tubing and the transmission line, the required width of the assembly may be cost prohibitive. Indeed, each inch of diameter for the wellbore may significantly increase the cost of drilling.

SUMMARY OF THE INVENTION

In view of the foregoing background, it is therefore an object of the present invention to provide an antenna assembly that is low profile and readily installed in a wellbore.

This and other objects, features, and advantages in accordance with the present invention are provided by an antenna assembly suitable to be positioned within a wellbore in a subterranean formation. The antenna assembly comprises a tubular antenna element to be positioned within the wellbore, and an RF coaxial transmission line to be positioned within the tubular antenna element. The RF coaxial transmission line comprises a series of coaxial sections coupled together in end-to-end relation, each coaxial section comprising an inner conductor, an outer conductor surrounding the inner conductor, and a dielectric therebetween. Each of the outer conductors has opposing threaded ends defining overlapping mechanical threaded joints with adjacent outer conductors. Advantageously, the RF coaxial transmission line may have reduced cross-sectional size, thereby permitting easier installation into the antenna assembly.

More specifically, each opposing threaded end of the outer conductor may define an electrical joint with the adjacent outer conductors. Each electrical joint may comprise an electrically conductive compression joint.

In some embodiments, each overlapping mechanical threaded joint may have at least one threading relief recess therein. Each overlapping mechanical threaded joint may comprise at least one sealing ring. Each of the outer conductors may also comprise a plurality of tool-receiving recesses on an outer surface thereof.

Additionally, each coaxial section may further comprise a dielectric spacer carried at the threaded end of the outer conductor and having a bore therethrough, and an inner conductor coupler carried by the bore of the dielectric spacer and electrically coupling adjacent ends of the inner conductor. The tubular antenna element may be spaced from the outer conductor to define a fluid passageway therethrough, and the outer conductor may be spaced from the inner conductor to define a fluid passageway therethrough. The antenna assembly may also include a dielectric spacer between the tubular antenna element and the RF coaxial transmission line.

Another aspect is directed to a method of making an RF coaxial transmission line for an antenna assembly to be positioned within a wellbore in a subterranean formation, the antenna assembly comprising a tubular antenna element. The method comprises forming the RF coaxial transmission line to be positioned within the tubular antenna element. The RF coaxial transmission line comprises a series of coaxial sections coupled together in end-to-end relation, each coaxial section comprising an inner conductor, an outer conductor surrounding the inner conductor, and a dielectric therebetween. Each of the outer conductors has opposing threaded ends defining overlapping mechanical threaded joints with adjacent outer conductors.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
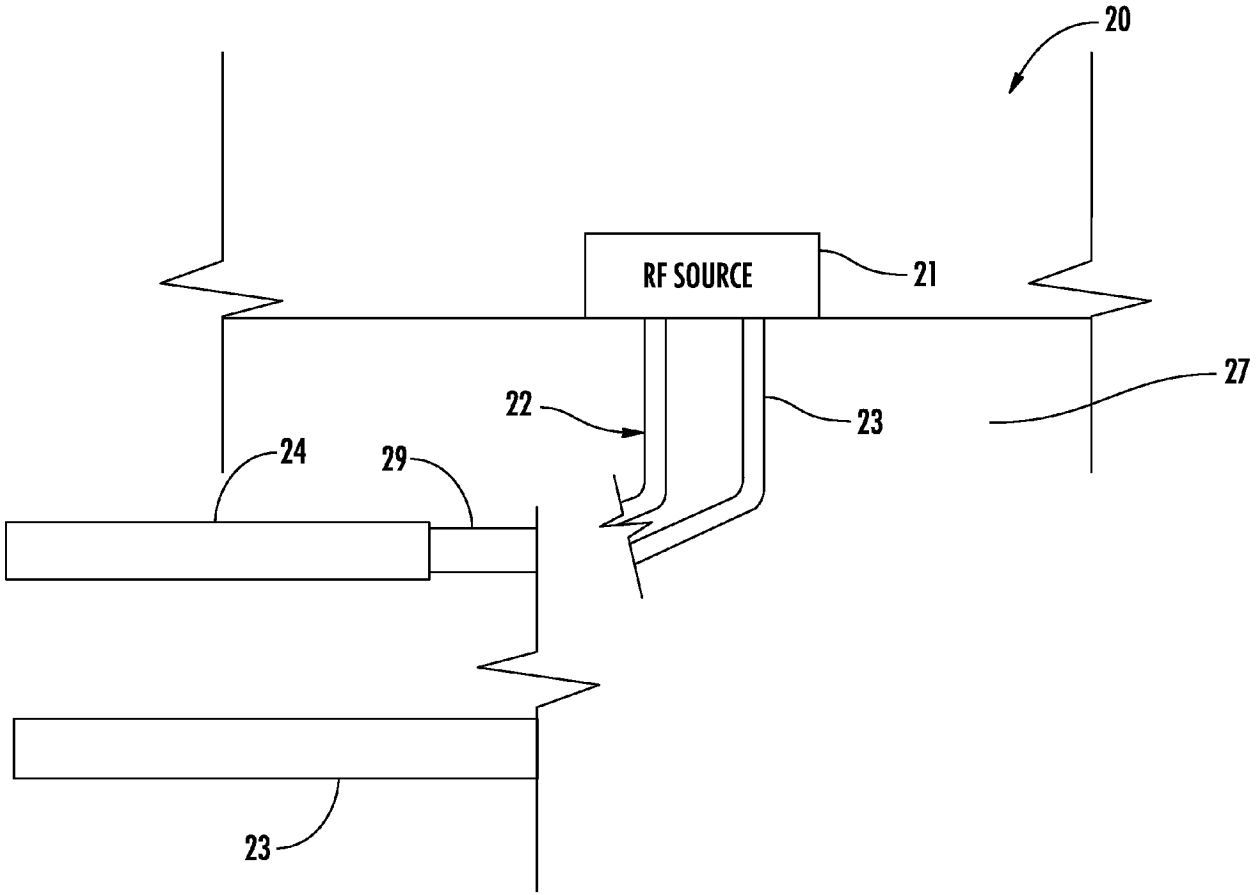
FIG. 1 is a schematic diagram of an antenna assembly in a subterranean formation, according to the present invention.

Referring initially to FIG. 1, a hydrocarbon recovery system 20 according to the present invention is now described. The hydrocarbon recovery system 20 includes an injector well 22, and a producer well 23 positioned within a wellbore in a subterranean formation 27. The injector well 22 includes an antenna assembly (transducer assembly) 24 at a distal end thereof. The hydrocarbon recovery system 20 includes an RF source 21 for driving the antenna assembly 24 to generate RF heating of the subterranean formation 27 adjacent the injector well 22.

Figure 2:
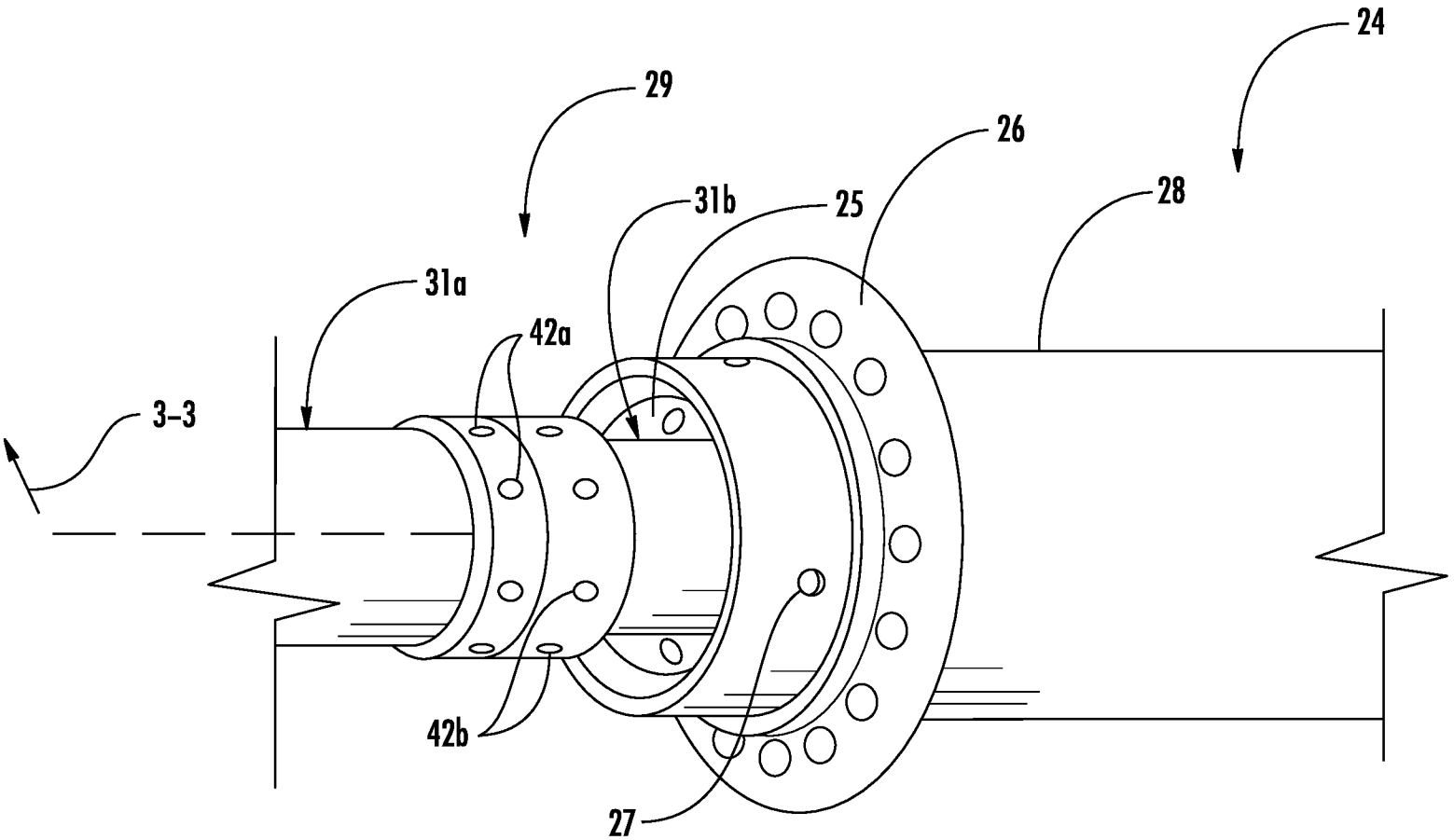
FIG. 2 is a perspective view of adjacent coupled RF coaxial transmission lines in the antenna assembly of FIG. 1.
Figure 3:
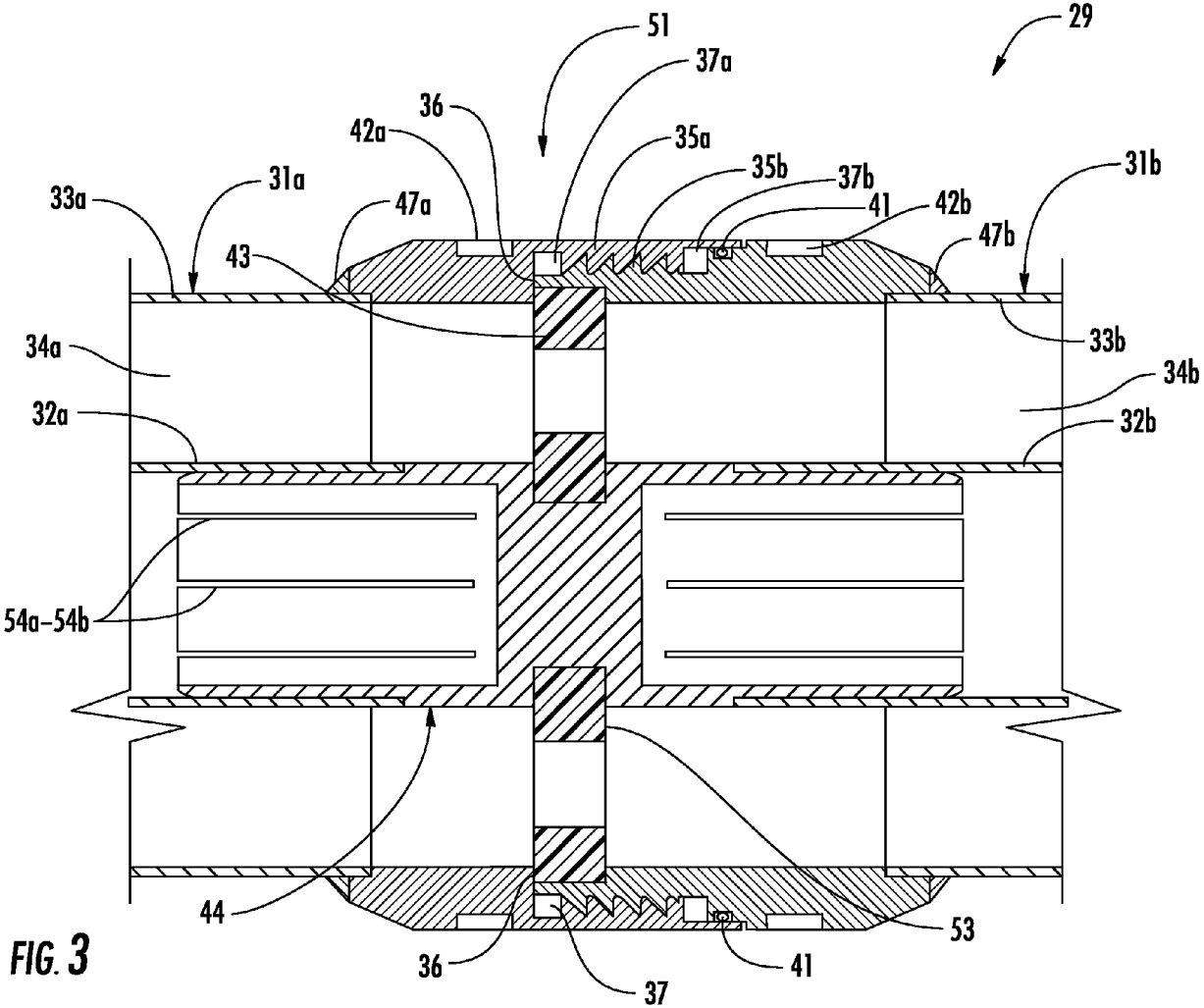
FIG. 3 is a cross-sectional view along line 3-3 of adjacent coupled RF coaxial transmission lines in the antenna assembly of FIG. 2.
Figure 4:
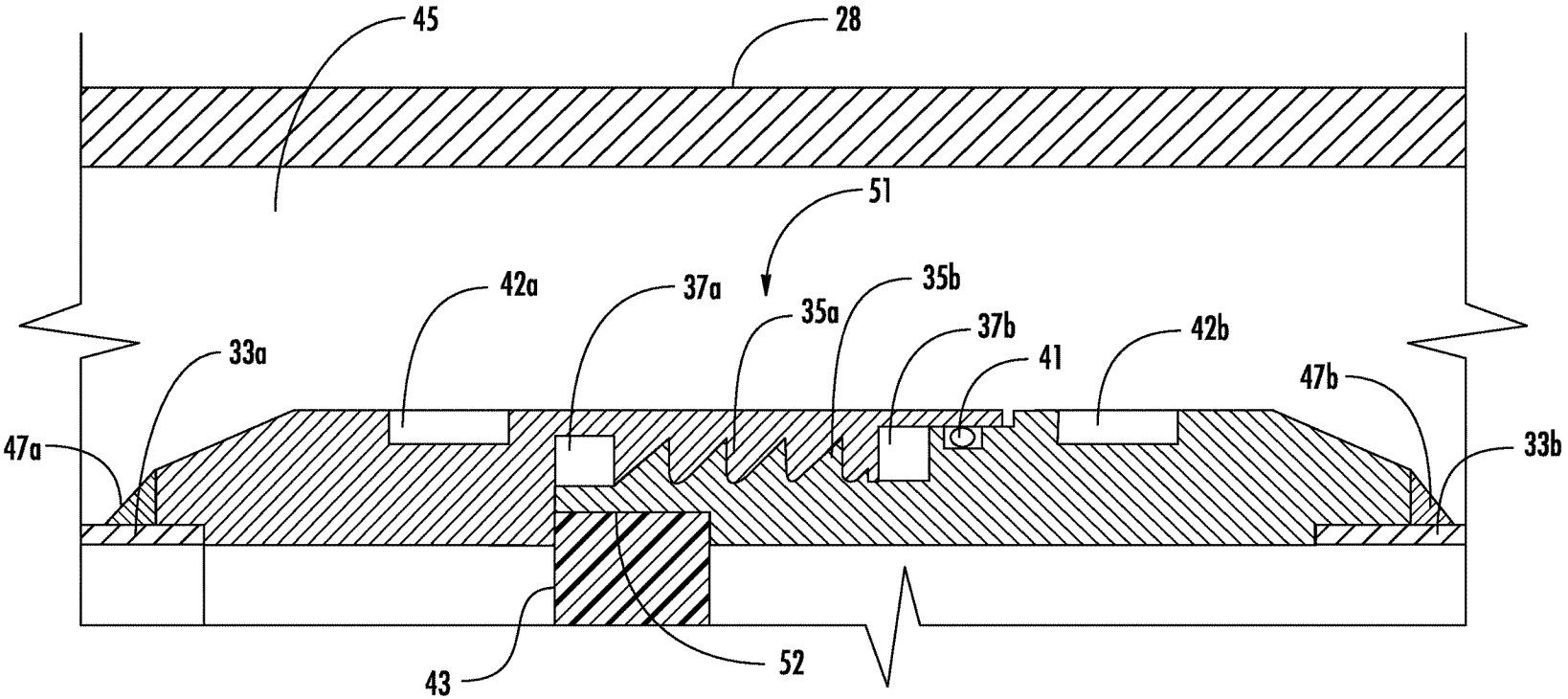
FIG. 4 is an enlarged portion of the cross-sectional view of FIG. 3.
Figure 6:
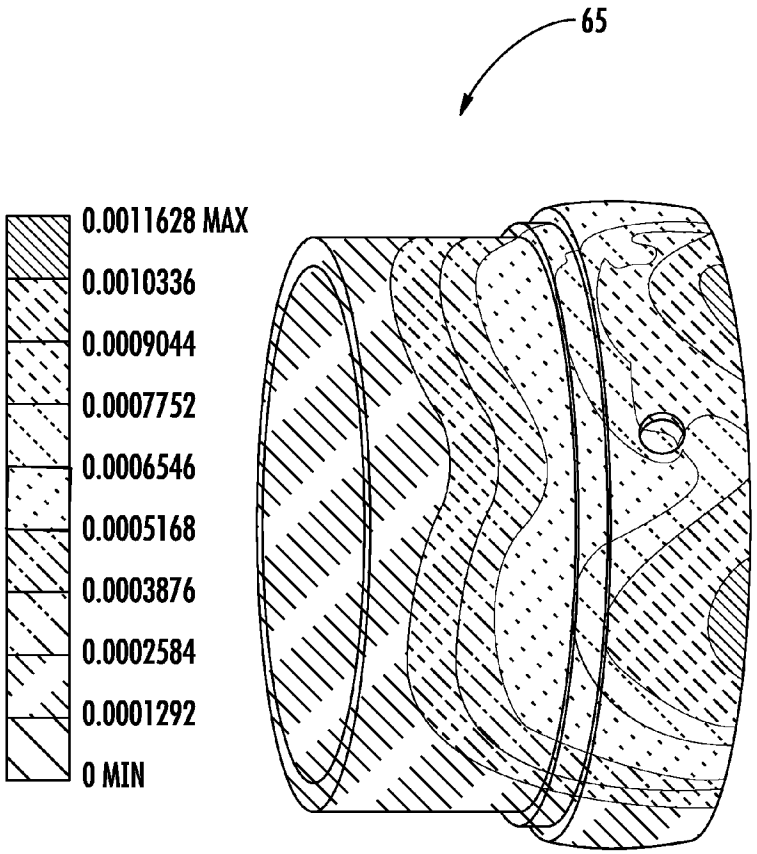
FIGS. 5-6 are diagrams of maximum torque load and resultant stress, respectively, for the connectors from the RF coaxial transmission lines of FIG. 2.
Figure 5:
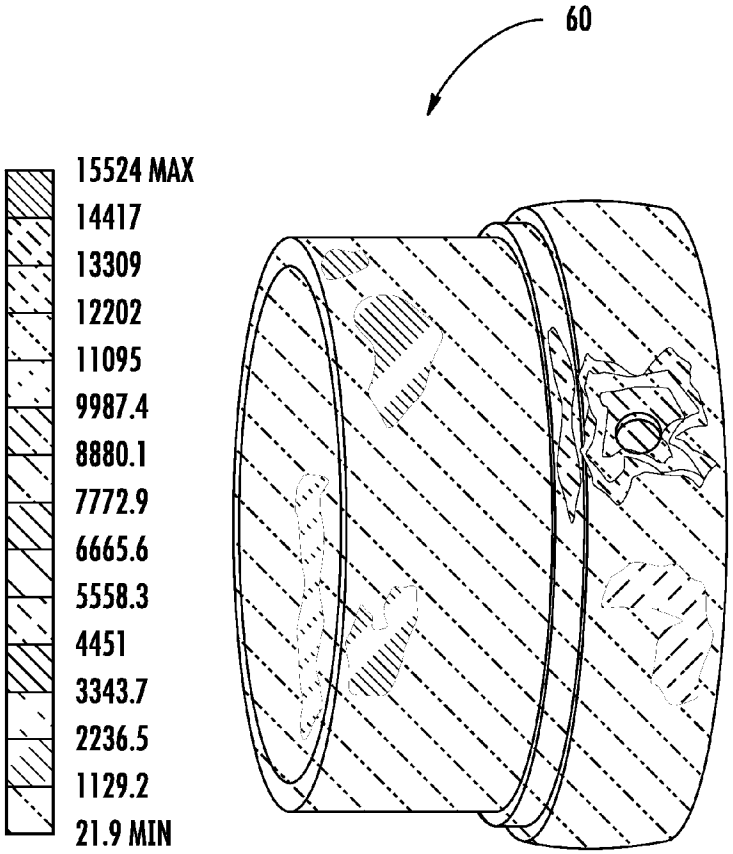
Figure 8:
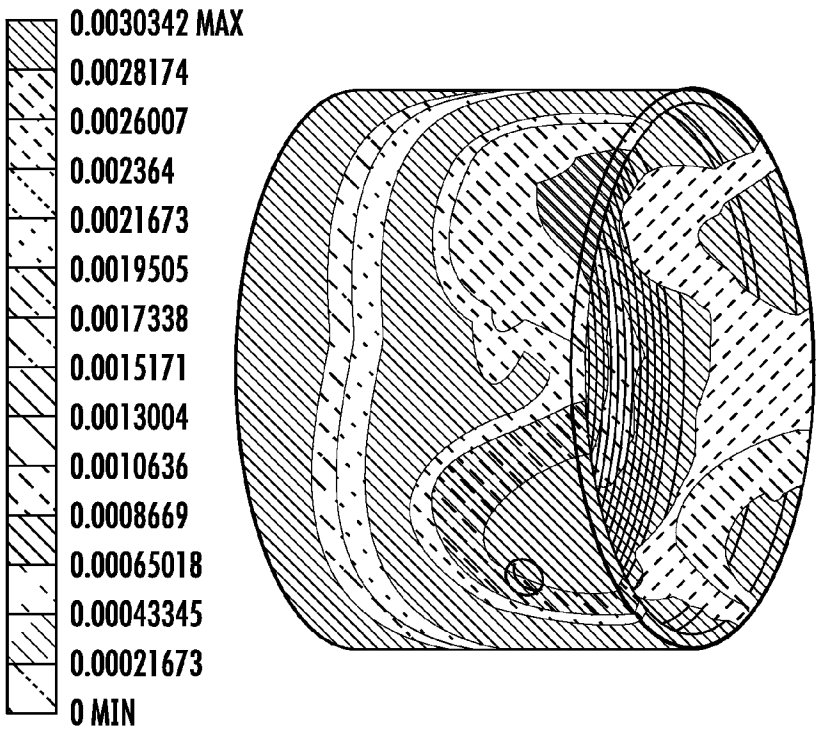
FIGS. 7-8 are additional diagrams of maximum torque load and resultant stress, respectively, for the connectors from the RF coaxial transmission lines of FIG. 2.
Figure 7:
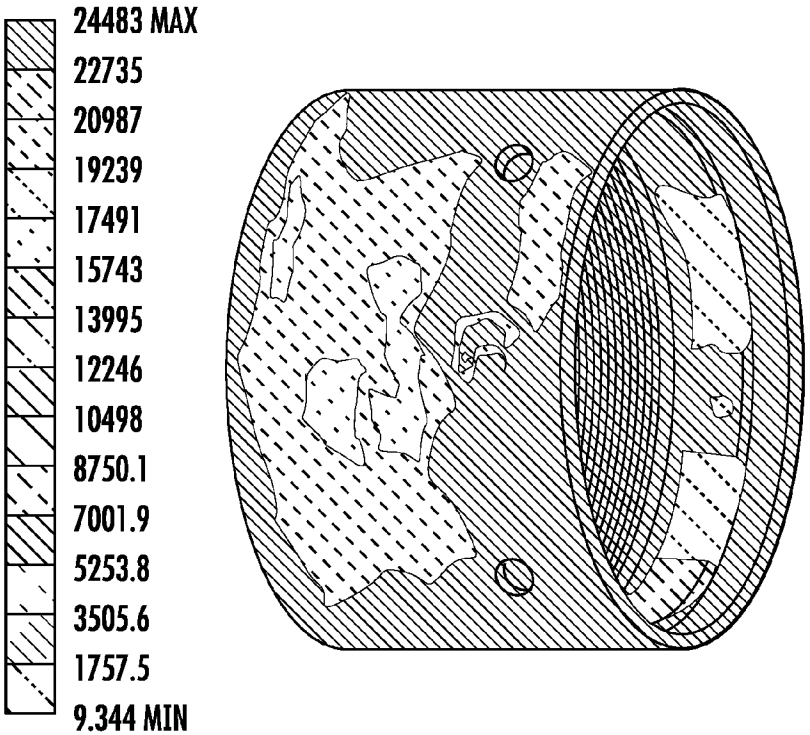
Figure 10:
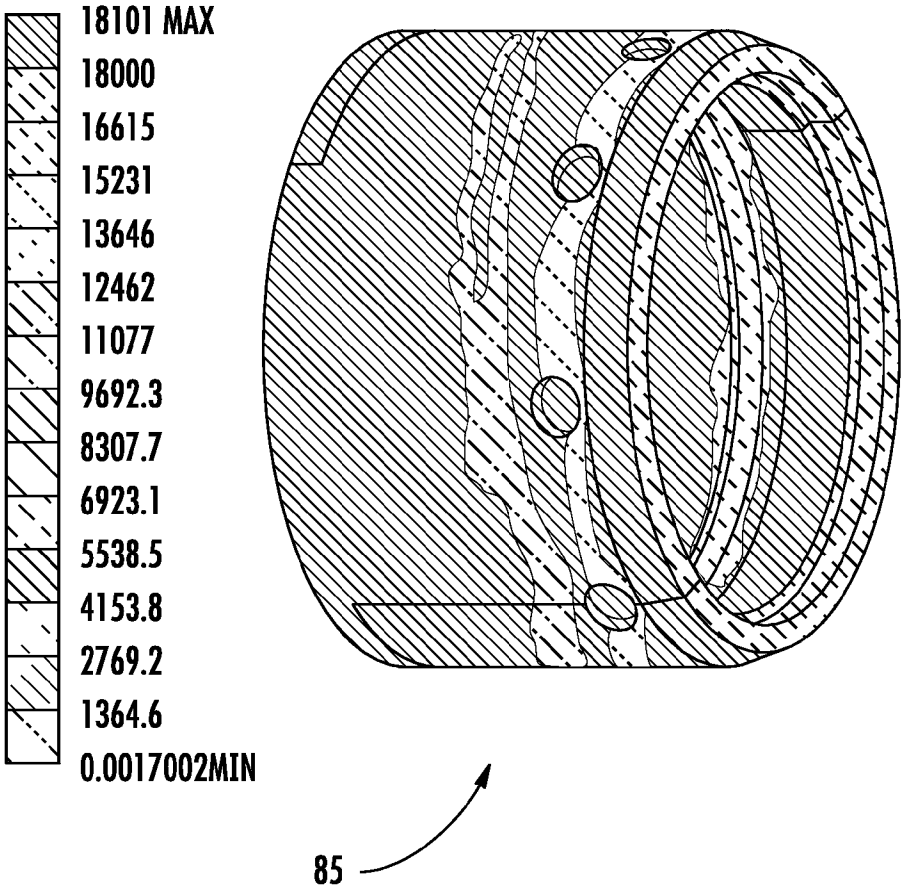
FIGS. 9-10 are diagrams of maximum live load and resultant stress, respectively, for the connectors from the RF coaxial transmission lines of FIG. 2.
Figure 9:
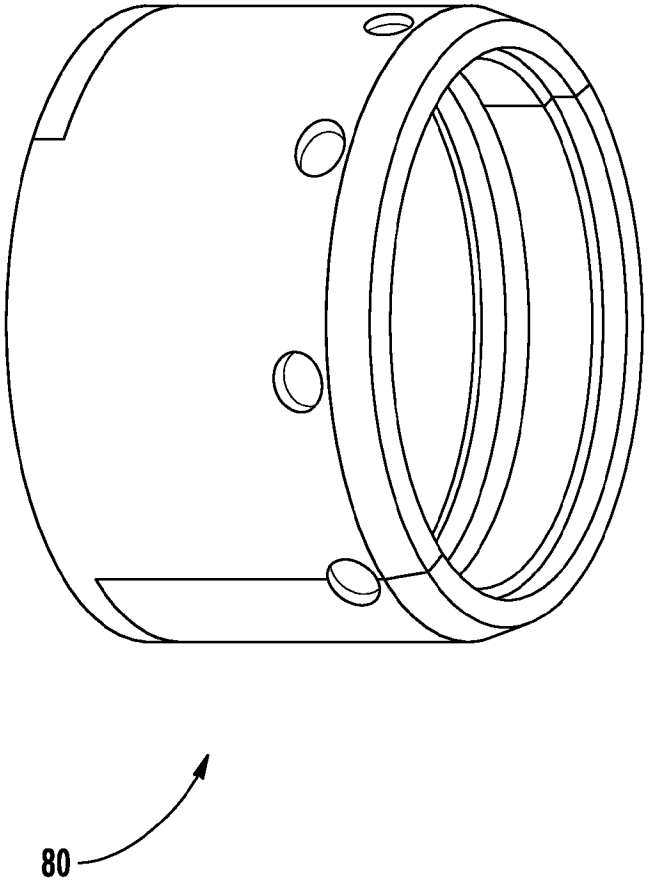

Referring now additionally to FIGS. 2-4, the antenna assembly 24 comprises a tubular antenna (transducer) element 28, for example, a center fed dipole antenna, to be positioned within the wellbore, and a RF coaxial transmission line 29 to be positioned within the tubular antenna element. The antenna assembly 24 may comprise a plurality of tubular antenna (transducer) elements coupled together end-to-end. The RF coaxial transmission line 29 comprises a series of coaxial sections 31*a*-31*b* coupled together in end-to-end relation. The tubular antenna element 28 also includes a plurality of tool-receiving recesses 27 for utilization of a torque tool in assembly thereof.

Each coaxial section 31*a*-31*b* comprises an inner conductor 32*a*-32*b*, an outer conductor 33*a*-33*b* surrounding the inner conductor, and a dielectric 34*a*-34*b* therebetween. For example, the dielectric 34*a*-34*b* may comprise air. The antenna assembly 24 includes a dielectric spacer 25 between the tubular antenna element 28 and the RF coaxial transmission line 29, and an outer dielectric spacer 26 on the outer surface of the tubular antenna element. The outer dielectric spacer 26 may serve as a centering ring for the antenna assembly 24 while in the wellbore. For example, the inner and outer conductors 32*a*-32*b*, 33*a*-33*b* may comprise at least one of aluminum, copper, and stainless steel. The inner conductor 32*a*-32*b* may comprise copper or aluminum. The outer conductor 33*a*-33*b* may comprise any of the three. The tubular antenna element 28 is the main structural element (large OD and thick walls). The tubular antenna element 28 supports/cradles the RF coaxial transmission line 29 using the dielectric spacers 25. These dielectric spacers 25 support the RF coaxial transmission line 29 radial but allow for thermal expansion of the tubular antenna element 28 relative to the transmission line axial. During use, the tubular antenna element 28 is used to position the transmission line in the wellbore. Advantageously, this provides mechanical resiliency and strength, thereby preventing a thin walled transmission line from buckling.

Each of the outer conductors 33*a*-33*b* has opposing threaded ends 35*a*-35*b* defining overlapping mechanical threaded joints 51 with adjacent outer conductors. More specifically, each opposing threaded end 35*a*-35*b* of the outer conductor 33*a*-33*b* may define an electrical joint 36 with the adjacent outer conductors. Each electrical joint 36 includes an electrically conductive compression joint. Of course, the sizing of the opposing threaded ends 35*a*-35*b* shown in the illustrated embodiment are exemplary, and can vary depending on the application, such as the pressure and strength requirements.

In the illustrated embodiment, each overlapping mechanical threaded joint 51 includes a pair of threading relief recess 37*a*-37*b* therein. Each overlapping mechanical threaded joint 51 includes a sealing ring 41, and a corresponding recess therefor. Advantageously, the sealing ring is captivated by the opposing threaded ends 35*a*-35*b*, thereby increasing reliability of the seal and providing a static wiping seal. In other embodiments, the overlapping mechanical threaded joint 51 may include a plurality of sealing rings, but these embodiments may be more likely to experience a blowout due to the high pressure environment. Each of the outer conductors 33*a*-33*b* includes a plurality of tool-receiving recesses 42*a*-42*b* on an outer surface thereof. In the illustrated embodiment, the tool-receiving recesses 42*a*-42*b* are circular in shape, but may, in other embodiments, have varying shapes, such as a hexagonal shape. Advantageously, the tool-receiving recesses 42*a*-42*b* provide for quick and sure assembly of the coaxial sections 31*a*-31*b* with a simple torque wrench tool, such as a pin style wrench.

Additionally, each coaxial section 31*a*-31*b* includes a dielectric spacer 43 carried at the threaded end of the outer conductor 33*a*-33*b* and having a bore 53 therethrough. In particular, the threaded end of the outer conductor 33*a*-33*b* includes a recess 52 for receiving the dielectric spacer 43. In another embodiment, a recess on the female side of the threaded end of the outer conductor 33*a*-33*b* is provided.

Each coaxial section 31*a*-31*b* includes an inner conductor coupler 44 (bullet) carried (supported axially and radially) by the bore 53 of the dielectric spacer 43 and electrically coupling adjacent ends of the inner conductor 32*a*-32*b*. The inner conductor coupler 44 includes a plurality of slots 54*a*-54*b* extending from a medial portion thereof towards the inner conductor that act like a flexure to maintain electrical contact with inner conductor. Another embodiment of this includes the use of snap rings on the interior of the inner conductor coupler 44 to add additional preload to the slotted fingers.

In the some embodiments, each overlapping mechanical threaded joint 51 provides a hydraulic seal (i.e. a hydraulic piston seal) between each coaxial section 31*a*-31*b*. More specifically, the tubular antenna element 28 is spaced from the outer conductor 33*a*-33*b* to define a fluid passageway 45 therethrough, and the outer conductor may be spaced from the inner conductor 32*a*-32*b* to define another fluid passageway therethrough. In other embodiments, the inner conductor 32*a*-32*b* may include yet another fluid passageway therethrough. In the illustrated embodiment, the inner conductor coupler (bullet) 44 is not a fluid carrying bullet and does not provide a seal for passing fluids, but other embodiments may be so modified. The fluid passageway 45 facilitates application of certain fluids or gases to the wellbore that aid in hydrocarbon recovery or for the process of cooling the inner conductor 32*a*-32*b* of the transmission line. Also, in the illustrated embodiment, each outer conductor 33*a*-33*b* includes a welded joint 47*a*-47*b* for coupling the tubular conductor to the connector end thereof. The welded joint 47*a*-47*b* allows the precision machining of the aluminum, stainless steel, or Brass (would not use copper) threaded outer conductor couplers which are then welded to a choice length of tubular.

Advantageously, the RF coaxial transmission line 29 has a reduced cross-sectional size, thereby permitting easier installation into the antenna assembly 24. In particular, the coaxial sections 31*a*-31*b* of the RF coaxial transmission line 29 do not include the wide bolted flanges as their connections, such as in typical approaches. This permits the coaxial sections 31*a*-31*b* to require less space within the antenna assembly 24, which reduces the cost of drilling the wellbore. Moreover, the low profile size of the RF coaxial transmission line 29 permits a large dielectric spacer 43, which prevents arching and allows greater voltages to be used.

Additionally, the ease of assembly using a simple torque tool reduces typical installing time by 90%, and is capable of application in overhead installations. Moreover, in some embodiments, the overlapping mechanical threaded joint 51 comprises a single type of metal, which may reduce corrosion issues.

Another aspect is directed to a method of making an RF coaxial transmission line 29 for an antenna assembly 24 to be positioned within a wellbore in a subterranean formation 27, the antenna assembly comprising a tubular antenna element 28. The method comprises forming the RF coaxial transmission line 29 to be positioned within the tubular antenna element 28. The RF coaxial transmission line 29 comprises a series of coaxial sections 31*a*-31*b* coupled together in end-to-end relation, each coaxial section comprising an inner conductor 32*a*-32*b*, an outer conductor 33*a*-33*b* surrounding the inner conductor, and a dielectric 34*a*-34*b* (e.g. air space) therebetween. Each of the outer conductors 33*a*-33*b* has opposing threaded ends 35*a*-35*b* defining overlapping mechanical threaded joints with adjacent outer conductors.

Referring now to FIG. 6-10, a diagrams 60 & 70, 65 & 75 respectively show maximum toque (pin loads in PSI) and resultant stress (total deformation in inches) for the connector portions of the coaxial sections 31*a*-31*b*. Diagram 80 shows maximum live load for the connector, and diagram 85 shows resultant stress (pin loads in PSI). Advantageously, the connectors may be minimally stressed during torquing. The female coupler may have higher stress due to thin walls at threaded relief recesses 37*a*. In the diagrams, the tension and compression are analyzed using worst case for margin calculations. Also, the threading relief recess 37*a* may be strength limiting section of connector portion, but the conductive tube and connector strengths closely matched. The joints between the coaxial sections 31*a*-31*b* are maintained by the torque. The diagrams 60 & 70, 65 & 75 are for load cases (tension, compression, live load, thermal) that show that preload is maintained and stress are low on the part.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna assembly suitable to be positioned within a wellbore in a subterranean formation, the antenna assembly comprising:

a tubular antenna element in the wellbore of the subterranean formation and configured to generate radio frequency (RF) heating of the subterranean formation adjacent the tubular antenna element; and an RF coaxial transmission line configured to be positioned within said tubular antenna element, the RF coaxial transmission line comprising a series of coaxial sections coupled together in end-to-end relation, each coaxial section comprising an inner conductor, an outer conductor surrounding said inner conductor, and a dielectric therebetween;

each of said outer conductors having opposing threaded ends defining overlapping mechanical threaded joints with adjacent outer conductors.

2. The antenna assembly according to claim 1 wherein each opposing threaded end of said outer conductor defines an electrical joint with the adjacent outer conductors.

3. The antenna assembly according to claim 2 wherein each electrical joint comprises an electrically conductive compression joint.

4. The antenna assembly according to claim 1 wherein each overlapping mechanical threaded joint has at least one threading relief recess therein.

5. The antenna assembly according to claim 1 wherein each overlapping mechanical threaded joint comprises at least one sealing ring.

6. The antenna assembly according to claim 1 wherein each of said outer conductors comprises a plurality of tool-receiving recesses on an outer surface thereof.

7. The antenna assembly according to claim 1 wherein each coaxial section further comprises:

a dielectric spacer carried at the threaded end of said outer conductor and having a bore therethrough; and an inner conductor coupler carried by said bore of said dielectric spacer and electrically coupling adjacent ends of said inner conductor.

8. The antenna assembly according to claim 1 wherein said tubular antenna element is spaced from said outer conductor to define a fluid passageway therethrough.

9. The antenna assembly according to claim 1 wherein said outer conductor is spaced from said inner conductor to define a fluid passageway therethrough.

10. The antenna assembly according to claim 1 further comprising a dielectric spacer between said tubular antenna element and said RF coaxial transmission line.

11. An antenna assembly suitable to be positioned within a wellbore in a subterranean formation, the antenna assembly comprising:

a tubular antenna element in the wellbore of the subterranean formation and configured to generate radio frequency (RF) heating of the subterranean formation adjacent the tubular antenna element; and an RF coaxial transmission line configured to be positioned within said tubular antenna element, the RF coaxial transmission line comprising a series of coaxial sections coupled together in end-to-end relation, each coaxial section comprising:

an inner conductor;

an outer conductor surrounding said inner conductor;

a dielectric between said inner and outer conductors;

a dielectric spacer carried at an end of said outer conductor and having a bore therethrough; and an inner conductor coupler carried by said bore of said dielectric spacer and electrically coupling adjacent ends of said inner conductor;

each of said outer conductors having opposing threaded ends defining overlapping mechanical threaded joints with adjacent outer conductors and an electrical joint with the adjacent outer conductors.

12. The antenna assembly according to claim 11 wherein each electrical joint comprises an electrically conductive compression joint.

13. The antenna assembly according to claim 11 wherein each overlapping mechanical threaded joint has at least one threading relief recess therein.

14. The antenna assembly according to claim 11 wherein each overlapping mechanical threaded joint comprises at least one sealing ring.

15. The antenna assembly according to claim 11 wherein each of said outer conductors comprises a plurality of tool-receiving recesses on an outer surface thereof.

16. The antenna assembly according to claim 11 wherein said tubular antenna element is spaced from said outer conductor to define a fluid passageway therethrough.

17. The antenna assembly according to claim 1 further comprising an outer dielectric spacer on an outer surface of said tubular antenna element.

18. The antenna assembly according to claim 11 further comprising an outer dielectric spacer on an outer surface of said tubular antenna element.

* * * * *